US006453478B1

(12) United States Patent
Semmler

(10) Patent No.: US 6,453,478 B1
(45) Date of Patent: Sep. 24, 2002

(54) FASTENING ELEMENT FOR A TOILET SEAT

(76) Inventor: Axel Semmler, Kannenhofer Weg 100, 41066 Mönchengladbach (DE)

( * ) Notice: Subject to any disclaimer, the term of this patent is extended or adjusted under 35 U.S.C. 154(b) by 0 days.

(21) Appl. No.: 09/839,692

(22) Filed: Apr. 20, 2001

(51) Int. Cl.[7] ..... A47K 13/12
(52) U.S. Cl. ..... 4/236; 4/240
(58) Field of Search ..... 4/236, 240

(56) References Cited

U.S. PATENT DOCUMENTS 3,063,063 A * 11/1962 Brooks ..... 4/236
3,479,068 A * 11/1969 Brittain ..... 285/321
4,079,471 A * 3/1978 Corda ..... 4/240
6,071,034 A * 6/2000 Cavagna ..... 4/240 X

* cited by examiner

*Primary Examiner*—Charles E. Phillips
(74) *Attorney, Agent, or Firm*—Joan Pennington

(57) ABSTRACT

The invention concerns a fastening element for a toilet seat including a base member (14) to be fastened to the toilet pan and at least one arm (2, 16) to be fastened to the toilet seat ring and/or the toilet lid. Provided between the arm (2, 16) and the base member (14) is a quick-action fastening, preferably in the form of a push-in connection by means of a pin (11) which is held by means of a spring ring (12). That permits easy dismantleability and thus complete and hygienically satisfactory cleaning of the toilet.

6 Claims, 3 Drawing Sheets

FASTENING ELEMENT FOR A TOILET SEAT

Figure 1:
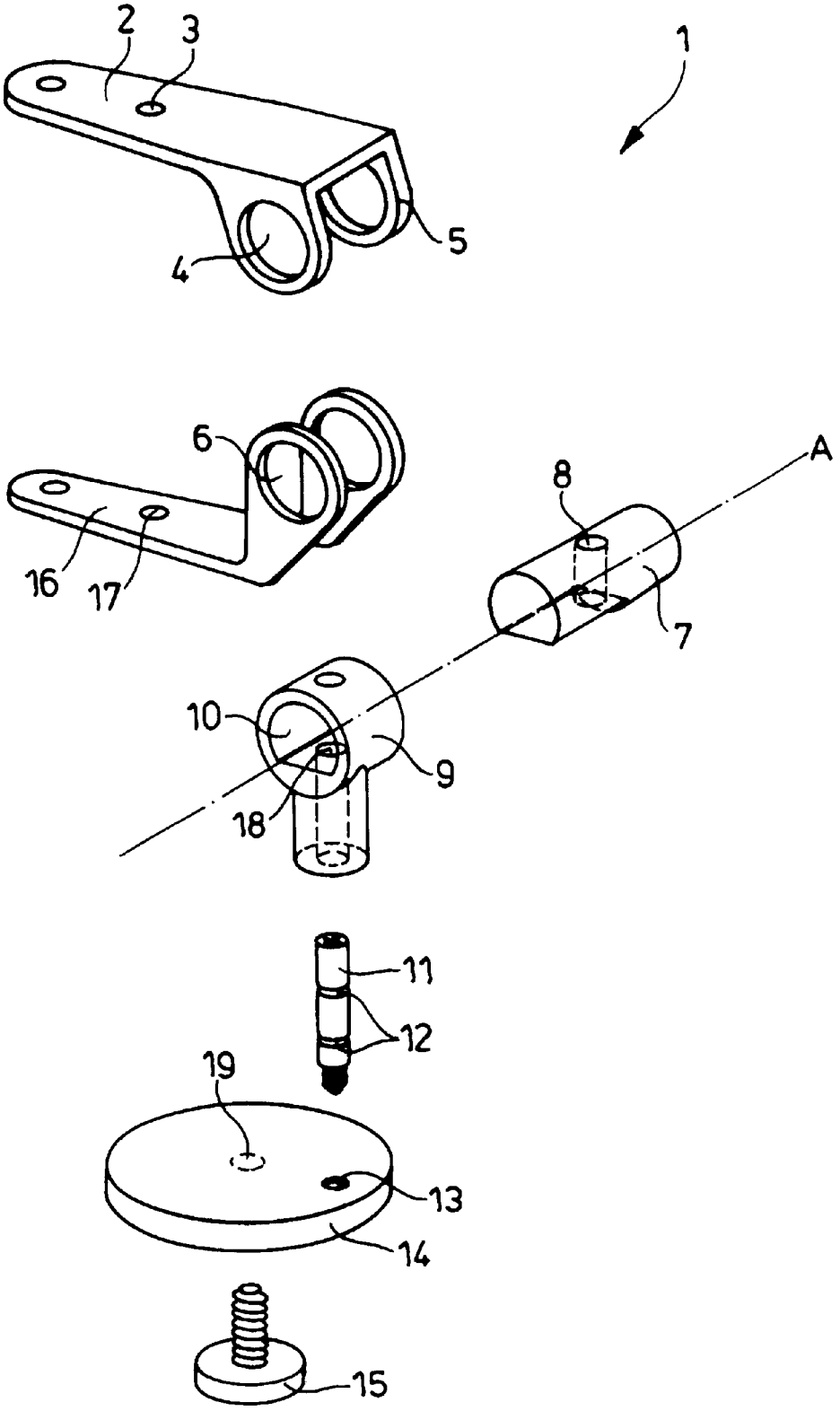

The present invention concerns a fastening element for a toilet seat including a base member which is to be fixed to the toilet pan and at least one arm which is to be fixed to the toilet seat ring and/or the toilet lid. The invention further concerns a toilet seat with a fastening element of that kind.

A toilet generally comprises a toilet pan and cover members for the opening of the toilet pan. The cover members are connected to the toilet pan pivotably movably about a horizontal pivot axis so that they can be pivoted into a position of opening the toilet pan. One of the cover members is generally formed by a toilet seat ring which is also referred to as the toilet seat member and which in the condition of being pivoted closed extends over the edge of the toilet pan in order to permit a person to sit more conveniently and comfortably on the toilet. In addition the cover members generally include a toilet lid which closes the opening of the toilet pan when it is not in use.

The toilet pan and the above-mentioned cover members have to be pivotably movably connected together by way of a suitable fastening element. Two perpendicular through bores are provided in the rearward region of the toilet pan for mounting such a fastening element to the toilet pan which generally comprises ceramic. In the case of known fastening elements, secured to each of the through bores in the toilet pan is a respective base member having a pin which firstly points upwardly and which then bends over at a right angle into the horizontal. In that case the horizontally extending end portion of the pin is parallel to the pivot axis of the cover members. In that arrangement, a hinge connection to the cover members can be of such a design configuration that an arm which is to be fastened to the toilet seat ring and/or the toilet lid, with a suitable bore for receiving the pin, is pushed over the horizontally extending end portion of the angled pin. The arm is thereby mounted on the pin rotatably about the pivot axis. Fastening the arm to the toilet seat ring or the toilet lid respectively, which is effected on the other hand, in that manner provides the desired hinge connection. The above-mentioned arm can possibly also be formed integrally with the toilet seat ring or the toilet lid respectively.

The procedure for fitting an element of that kind is such that firstly the arms are fastened to the toilet seat ring or the toilet lid respectively, which can be effected for example by a screw connection. Then the base members with the angled pin ends are fitted into the through bores in the arms and the unit which is assembled in that way is fitted onto the toilet pan and fastened through the above-mentioned holes in the toilet pan. The above-indicated fastening procedure can possibly also take place in the reverse sequence, that is to say, beginning with fastening the base members to the toilet pan. At any event the result is a permanent connection between the toilet pan and the cover members, which can be undone only by extensive measures such as releasing screws. This means that rapid and temporary removal of the cover members from the toilet is not possible. That however gives rise to problems in regard to hygiene as the constricted and concealed regions around the fastening element cannot be properly cleaned.

The object of the present invention was to improve a fastening element of the kind set forth in the opening part of this specification, in such a way as to permit complete and hygienically satisfactory cleaning of the toilet.

That object is attained in that, in a fastening element for a toilet seat which includes a base member to be fastened to the toilet pan and at least one arm to be fastened to the toilet seat ring and/or the toilet lid, a quick-action fastening is provided between the arm and the base member. The quick-action fastening permits rapid release and renewed fastening of the cover members (toilet seat ring, toilet lid) from the toilet pan so that those members can be removed without any problem in particular during cleaning of the toilet. That means that the entire toilet pan as well as the cover members can be well cleaned, in which respect in particular also the cover members can be taken away for cleaning at another location which is more appropriate for that purpose.

There are various possible options available in regard to the configuration of the quick-action fastening. In the simplest case the fastening element which is discussed in the opening part of this specification and which is known from the state of the art can be modified in such a way that, instead of the bore which is closed all around, the arms have pincer-like resilient elements which can be fitted onto the horizontally angled pin element of the base member similarly to a clothes-pin.

A preferred configuration of the fastening element however provides a sleeve member which is arranged between the arm and the base member and which is rotatably movably connected to the arm, wherein means for quick-action fastening of the two members to each other are arranged on the sleeve member and on the base member. Arranging the sleeve member as an intermediate member between the arm and the base member affords the advantage that the hinge axis for the pivotal movement of the cover members can be designed separately from the quick-action fastening and can thus be optimised in terms of the properties to be required such as strength and resistance, smoothness of operation and the like. In the same manner, independently thereof, the quick-action fastening can be optimized for the purpose thereof, without compromise.

The means for a quick-action fastening between the sleeve member and the base member preferably comprise a push-in connection, wherein the push-in direction is advantageously perpendicular to the pivot axis. A push-in connection is distinguished in that two members are connected together by way of a plug element on the one member and a corresponding coupling on the other member, by means of a movement in the push-in direction, which is generally in a straight line. Orienting the push-in direction in perpendicular relationship to the pivot axis of the cover members has the advantage that in that way the cover members can be pulled off the toilet pan without having to be moved to the side. Movement to the side in that fashion could give rise to problems in regard to space, depending on the conditions at the place where the toilet is disposed.

A push-in connection between the sleeve member and the base member can preferably be obtained by a pin being arranged on the base member in perpendicular relationship to the pivot axis and by the sleeve member having a bore corresponding to the diameter of the pin. The sleeve member with the parts fastened thereto (arms, toilet seat ring, toilet lid) can then be pushed with the bore onto the pin on the base member, the outside diameter of the pin corresponding to the inside diameter of the bore, except for a play which is to be predetermined. Preferably, the bore of the sleeve member is of a slightly tapering configuration in order to permit an increasingly self-arresting fit for the pin. By virtue of being pushed onto the pin, the sleeve member is fastened on the toilet pan in such a way that it can only be pulled off by pulling in opposite relationship to the push-in direction. With the preferred perpendicular orientation of the pin on the base member, that pulling-off direction also faces perpendicularly upwardly so that generally the push-in connection cannot come lose by chance during the normal movement of the cover members.

In addition however for the sake of safety the pin may also have clamping members. They can prevent the sleeve member from being unintentionally pulled off as firstly the clamping devices have to be released or a corresponding clamping force has to be overcome. Preferably, a clamping member can be embodied by at least one spring ring which is arranged in a groove extending around the pin. The spring ring is of a size corresponding to the inside diameter of the bore in the sleeve and serves to stabilize the sleeve in the fitted condition.

The pin which projects perpendicularly upwardly from the base member is preferably arranged eccentrically on the base member. In other words, it is not aligned with the fastening axis of the base member on the toilet pan. The base member can be screwed on along the fastening axis in particular with corresponding screws in the holes provided for that purpose in the rearward region of the toilet pan. The eccentric position of the pin then means that the exact position of the pin can still be varied within limits and thus adapted by a rotary movement of the base member about the fixing axis.

The provision of a connection, which is rotatably movable about the pivot axis, between the sleeve member and the arm (or the arms) can be such that the sleeve member and the arm each have respective bores which are arranged in alignment in the direction of the pivot axis and in which is arranged a pin member for forming a rotatably movable connection between the sleeve member and the arm. In this case the pin member may have in particular a transverse bore in perpendicular relationship to the axis of the pin member. With the above-mentioned configuration of the fastening element with a pin on the base member, which fits in a corresponding bore in the sleeve member, that pin can engage into the transverse bore in the pin member and thereby arrest the pin member to prevent displacement in the direction of the axis of the pin member. That prevents the hinge joint from falling apart.

The pin member is preferably arranged non-rotatably in the sleeve member. It can then be arranged only in given angular orientations in the sleeve member, which in particular ensures correct orientation of the transverse bore.

The invention further concerns a toilet seat characterized in that arranged between the toilet seat ring and/or the toilet lid on the one hand and the toilet pan on the other hand are at least two fastening elements of the above-indicated kind. Two fastening elements of that kind ensure that the cover members are securely fitted on the toilet pan. In that respect, when providing a push-in connection of the kind described hereinbefore, the push-in directions of the two fastening elements should face in the same direction so that all fastening elements can be simultaneously pushed by a parallel movement onto the base members on the toilet pan.

Figure 2:
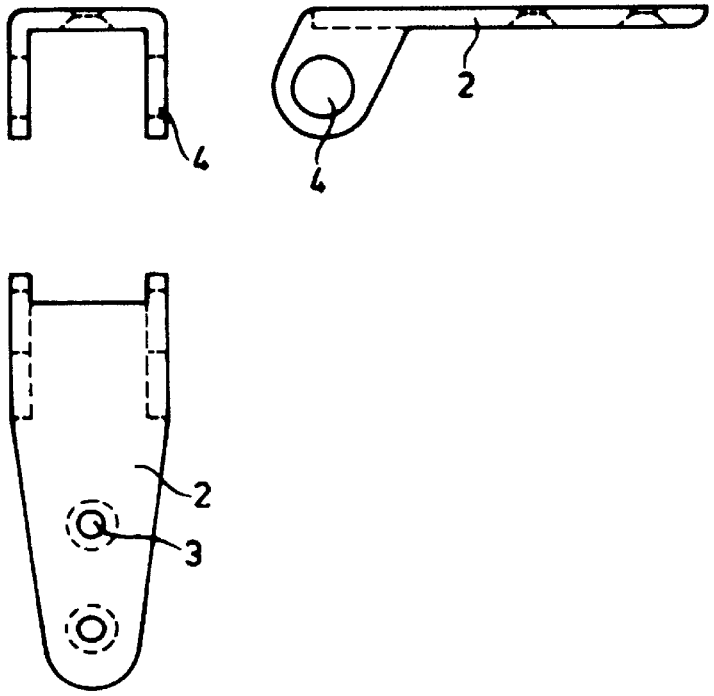
Figure 3:
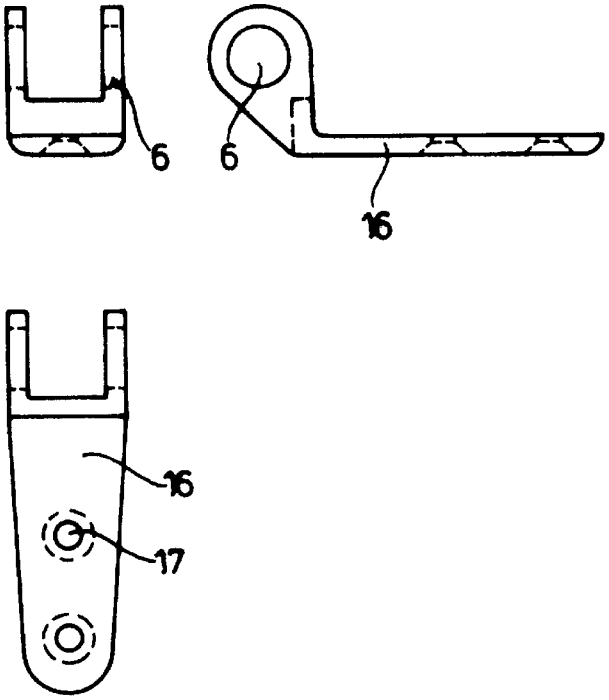
Figure 4:
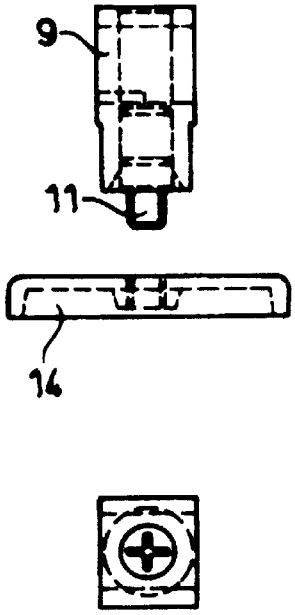
Figure 5:
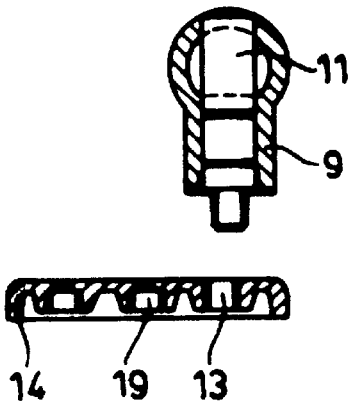
Figure 6:
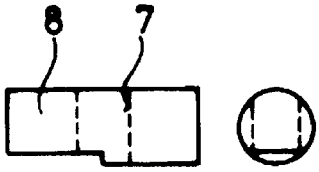
Figure 7:
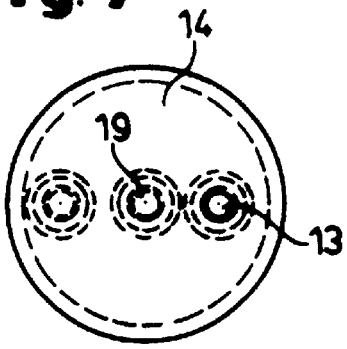

The invention is described by way of example hereinafter with reference to the Figures in which:

FIG. 1 is an exploded view of a fastening element according to the invention, FIG. 2 shows a plan view, a side view and a front view of an arm 2 of the fastening element of FIG. 1, FIG. 3 shows a plan, a side view and a front view of an arm 16 from FIG. 1, FIG. 4 shows a front view of the base member with pin and sleeve member fitted thereon, FIG. 5 shows a view in cross-section through the arrangement of FIG. 4, FIG. 6 shows a side view and a front view of the pin member, and FIG. 7 shows a plan view of the base member.

Referring to FIG. 1, shown therein is an exploded view of a fastening element according to the invention for a toilet seat, while FIGS. 2 through 7 show individual components of the arrangement in various views or sections (measured in millimeters).

The fastening element 1 serves to fasten a toilet seat ring and a toilet lid (not shown) to a toilet pan (not shown). The element comprises an arm 2 which by means of the screw holes 3 can be fastened to the toilet lid, an arm 16 which by means of the screw holes 17 can be fastened to the toilet seat ring, and a substantially disk-shaped base member 14 which is fastened to the toilet pan.

Fastening of the base member 14 is effected by means of a screw 15 which is passed from below through a suitable through bore at the rear end of the toilet pan and which on the upper side of the bore engages into a screwthread 19 which is arranged centrally at the underside of the base member 14. By tightening the screw 15 the base member 14 can thus be fastened on the toilet pan, in which case it covers over the through bores in the toilet pan. As can be seen in particular from FIGS. 5 and 7, besides the screwthread 19 there can also be at least one further (eccentric) screwthread at the underside of the base member 14 in order to afford an additional or alternative fastening point.

At its top side the base member 14 has an eccentrically arranged screwthreaded bore 13 into which a pin 11 projecting perpendicularly from the base member can be screwed with a suitable externally threaded portion at its lower end. The base member 14 when fitted to the toilet pan thus provides a pin which faces perpendicularly upwardly and onto which the rest of the fastening element can be fitted by a push-in connection, with the toilet cover members which are fixedly mounted to the fastening element.

That plug-in connection is made by means of a sleeve member 9 which comprises a cylindrical stem and a spherical head at the upper end. Along the axis of the cylindrical stem the sleeve member 9 is provided with a through bore 18 whose inside diameter corresponds to the outside diameter of the pin 11. Preferably, the bore can converge in a slightly tapering configuration in an upward direction in order thereby to permit the sleeve member 9 to be easily fitted with a push fit onto the pin 11 and to provide an increasingly firm fit for the pin 11 in the bore 18. For the purposes of fixing the sleeve member 9, milled on the pin 11 are grooves for receiving spring rings 12, the function of which is to strengthen the fit of the sleeve member 9 on the pin 11. When the sleeve member 9 is pushed onto the pin 11 the spring rings 12 bear with a resilient pressure against the inside wall of the bore 18 and thereby fix the sleeve member 9 on the axis of the pin 11 with which they are in positively engagement by way of the grooves. Grooves or channels into which spring rings can engage can possibly also be provided at the inside wall of the bore 18.

The head of the sleeve member 9 serves for forming a hinge pivot with the two arms 2 and 16. For that purpose, the head of the sleeve member 9 has a through bore 10 whose axis coincides with the pivot axis A and which is disposed perpendicularly to the above-mentioned bore 18 for receiving the pin 11. In a similar manner the arms 2 and 16 each have two flanges which project perpendicularly with respect to their longitudinal extent and in which are provided aligned through bores 4 and 6 respectively. The arms 2 and 16 can be arranged with those flanges around the head of the sleeve member 9 in such a way that all through bores 4, 6 and 10 are on the pivot axis A and are mutually aligned. The bores in this case are all of the same diameter. In order to provide a strong hinge connection a pin member 7 is then pushed along the pivot axis A through the bores in order to rotatably movably connect the sleeve member 9 and the two arms 2 and 16 together.

In perpendicular relationship to its axis the pin member 7 has a transverse bore 8 whose inside diameter corresponds to the diameter of the pin 11 on the base member 14. When the pin 11 is of a suitable length therefore, with the fastening element in the assembled condition, the pin 11 engages into the transverse bore 8 in the pin member 7 and fixes it to prevent displacement in the direction of the axis of the pin member 7. In addition the upper end of the pin 11 is accessible through the transverse bore 8 and can thus be re-tightened at any time, which is not possible in the case of hitherto conventional structures involving a base member 14 and a pin 11 as hitherto the pin 11 was usually fastened to the base member 14 from below by means of a screw. In that case, the base member 14 had to be completely removed for subsequently tightening the pin 11.

After removal of the fastening element from the pin 11 the pin member 7 is free in terms of axial displacement so that the hinge pivot can be easily dismantled. This has the advantage that the entire hinge pivot can also be thoroughly cleaned.

At one end the pin member 7 is preferably of a cross-section which is missing a sector to make a full circle. That sector is present on the sleeve member 9 in the corresponding part of the through bore 10. The arrangement of the pin member 7 in the through bore 10 is therefore a non-rotatable relationship, that is to say the pin member 7 can be arranged in the bore 10 only in one angular orientation. This ensures that the pin member when inserted is automatically so oriented that its transverse bore 8 is aligned with the bore 18 in the sleeve member 9.

What is claimed is:

1. A fastening element for a toilet seat including a base member which is to be fixed to the toilet pan and at least one arm which is to be fixed to the toilet seat ring and/or the toilet lid, characterized in that a quick-action fastening is provided between the arm (2, 16) and the base member (14);

a sleeve member (9) arranged between the arm (2, 16) and the base member (14), the sleeve member (9) connected to the arm rotatably movably about a pivot axis (A);

means (11, 18) arranged on the sleeve member and on the base member are for quick-action fastening of the two members to each other; said means for a quick-action fastening including a push-in connection, wherein the push-in direction is preferably in perpendicular relationship to the pivot axis (A);

a pin (11) arranged on the base member (14) in perpendicular relationship to the pivot axis (A) and that the sleeve member (9) has a bore (18) corresponding to the diameter of said pin;

the sleeve member (9) and the arm (2, 16) having respective bores (4, 16, 10) arranged in aligned relationship in the direction of the pivot axis (A) and a pin member (7) arranged in the respective bores (4, 16, 10) for providing a rotatably movable connection between the sleeve member and the arm.

2. A fastening element as set forth in claim 1 characterized in that the pin (11) has clamping elements, preferably in the form of at least one spring ring (12) arranged in a groove on the pin.

3. A fastening element as set forth in claim 1 characterized in that the pin (11) is arranged eccentrically on the base member (9).

4. A fastening element as set forth in claim 1 characterized in that the pin member (7) has a transverse bore (8) into which the pin (11) of the base member (14) engages.

5. A fastening element as set forth in claim 1 characterized in that the pin member (7) is arranged non-rotatably in the sleeve member (9).

6. A toilet seat as set forth in claim 1 characterized in that arranged between the toilet seat ring and/or the toilet lid on the one hand and the toilet pan on the other hand are at least two fastening elements (1).

* * * * *